US007165361B2

(12) United States Patent
Vanagan

(10) Patent No.: US 7,165,361 B2
(45) Date of Patent: Jan. 23, 2007

(54) BUILDING CONSTRUCTION SHORES

(76) Inventor: Peter Vanagan, 4562 Angus Dr., Vancouver (CA) V6J 4J5

( * ) Notice: Subject to any disclaimer, the term of this patent is extended or adjusted under 35 U.S.C. 154(b) by 307 days.

(21) Appl. No.: 10/421,724

(22) Filed: Apr. 24, 2003

(65) Prior Publication Data

US 2004/0211147 A1 Oct. 28, 2004

(51) Int. Cl.
*E04B 9/00* (2006.01)

(52) U.S. Cl. ..... 52/126.6; 52/638; 182/141; 182/178.6; 182/186.6; 248/354.3; 248/241

(58) Field of Classification Search ..... 52/126.6, 52/638, 639; 248/235, 354.3, 354.1, 241; 249/18, 210, 28; 182/178, 179, 186, 141, 182/178.1, 178.6, 186.6
See application file for complete search history.

(56) References Cited

U.S. PATENT DOCUMENTS 1,781,063 A * 11/1930 Jessen ..... 254/104
3,328,887 A * 7/1967 Wright ..... 33/372
4,481,748 A * 11/1984 D'Alessio et al. ..... 52/638
5,031,724 A * 7/1991 Quinn ..... 182/186.6
5,317,855 A * 6/1994 De Leeuw ..... 52/638
5,388,666 A * 2/1995 Schwoerer ..... 182/186.6
5,653,415 A * 8/1997 Schwoerer ..... 248/354.1
6,059,258 A * 5/2000 Jackson ..... 249/18
6,871,454 B1 * 3/2005 Coday et al. ..... 52/126.6
2003/0230700 A1 * 12/2003 Kemeny ..... 248/677
2004/0118065 A1 * 6/2004 Jackson et al. ..... 52/351
2005/0161571 A1 * 7/2005 Wood ..... 248/354.3
2006/0037666 A1 * 2/2006 Smith ..... 144/34.2

* cited by examiner

*Primary Examiner*—Jeanette E. Chapman
*Assistant Examiner*—Yvonne M. Horton
(74) *Attorney, Agent, or Firm*—Brian M Long

(57) ABSTRACT

An adjustable building construction shore has an inner tubular member extending internally of an outer tubular member and displaceable longitudinally of the outer tubular member, the inner and outer members having projecting and recessed longitudinal portions slidably interengaged and preventing relative rotation of the inner and outer tubular members. Openings extending transversely through the inner and outer tubular members are spaced apart longitudinally of the inner and outer tubular members, and retainer members extend through the openings for securing the inner and outer tubular members against relative longitudinal movement. A screw jack supports a lower end of the shore.

14 Claims, 8 Drawing Sheets

BUILDING CONSTRUCTION SHORES

BACKGROUND OF THE INVENTION

1. Field of the Invention

The present invention relates to building construction shores and to building construction shore assemblies, for use, for example, in supporting construction formwork during the erection of concrete buildings.

2. Description of the Related Art

In U.S. Pat. No. 5,379,599, issued Jan. 10, 1995, there is disclosed an adjustable height post for construction formwork which is made of aluminum and which comprises a threaded nut fastened to an outer tube, and an inner tube having threaded segments on the outer surface of the inner tube, these threaded segments being in threaded engagement with the nut. The threaded segments project into recesses in the outer tube and the inner tube is nonrotatably supported and guided in the outer tube. This prior shore therfore, has the disadvantage that rotation of the nut around the inner tube is required to adjust the length of the shore, which is can be unduly time-consuming.

BRIEF SUMMARY OF THE INVENTION

According to the present invention, there is provided an adjustable building construction shore which has an inner tubular member extending internally of an outer tubular member and projecting from one end of the outer tubular member. The inner tubular member is displaceable longitudinally of the outer tubular member, and the outer and inner tubular members are formed with openings extending transversely through the outer and inner tubular members and spaced apart longitudinally of the outer and inner tubular members. A retainer members extending through the openings releasably secures the outer and inner tubular members against relative longitudinal movement. A lower end of the shore is supported on a screw jack.

To adjust the length of the present shore, therefore, the retainer member can be withdrawn to allow relative longitudinal sliding adjustment of the inner and outer tubular members relative to one another, which can be accomplished rapidly and after which the retainer member can be reinserted and the screw jack can be employed for fine adjustment of the shore length.

The present invention further provides a pair of the adjustable building construction shores according to the present invention with a pair of cross braces extending between the shores. End portions of the cross braces are secured by fasteners to the shores.

In a preferred embodiment of the invention, the fasteners comprise T-bolts having heads engaged in the longitudinal formations and jam nuts in threaded engagement with the T-bolts and in jammed engagement with longitudinal formations.

BRIEF DESCRIPTION OF THE DRAWINGS

The invention will be more readily understood from the following description of preferred embodiments thereof given, by way of example, with reference to the accompanying drawings, in which.

DESCRIPTION OF THE PREFERRED EMBODIMENT

Figure 1:
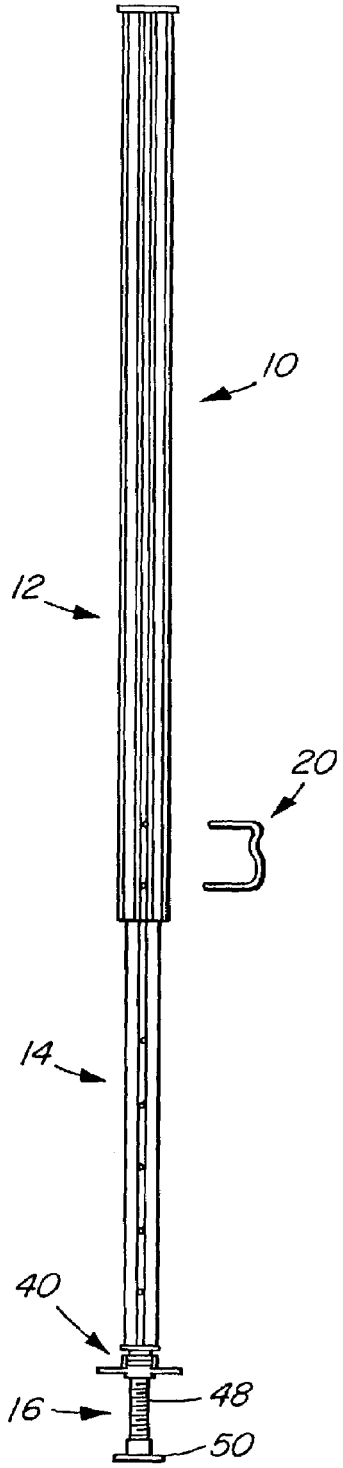
FIG. 1 shows a view in side elevation of a building construction shore embodying the present invention.

In FIG. 1 of the accompanying drawings, there is illustrated a shore indicated generally by reference numeral 10, which comprises an outer tubular member indicated generally by reference numeral 12 and an inner tubular member 14 indicated generally by reference numeral 14.

The inner tubular member 14 is telescopically interengaged with the outer tubular member 12, with a portion of the inner tubular member 14 projecting downwardly from the lower end of the outer tubular member 12.

The inner tubular member 14 has its lower end supported on a screwjack indicated generally reference numeral 16.

Figure 2:
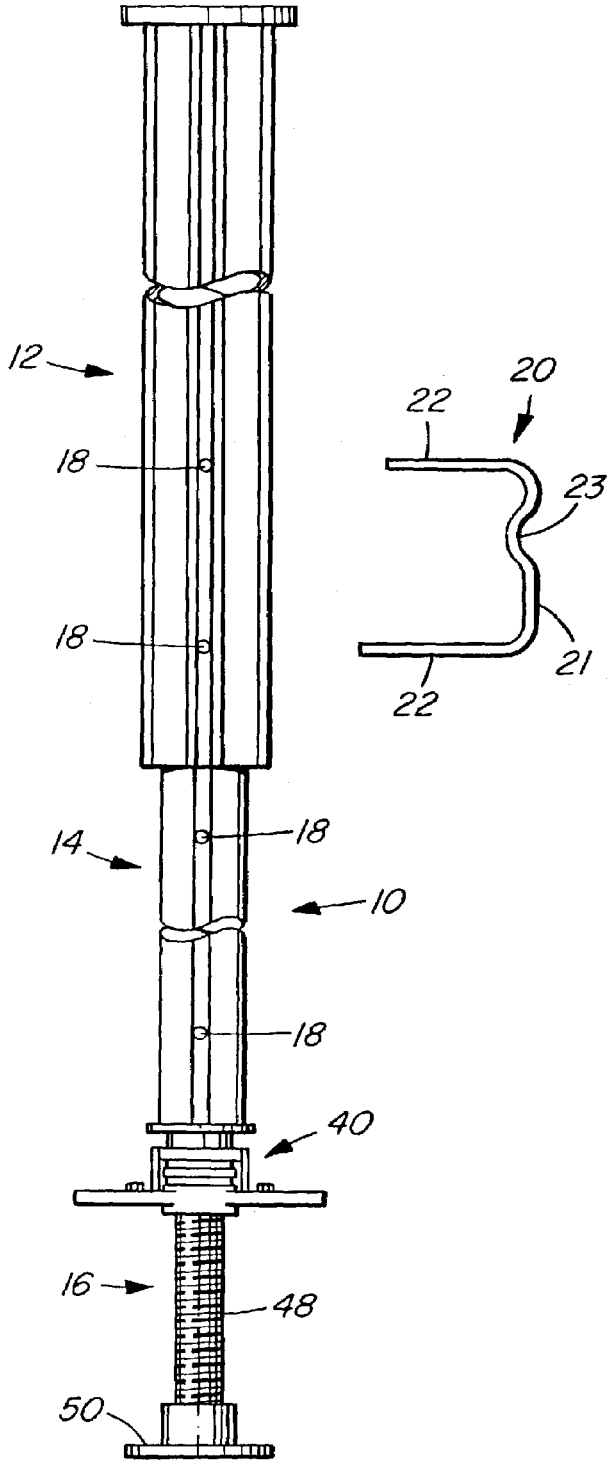
FIG. 2 shows a broken-away view, in side elevation and in an enlarged scale, of parts of the shore of FIG. 1.

Referring now to FIG. 2, which shows in greater detail portions of the shore 10 of FIG. 1, it will be seen that the outer and inner tubular members 12 and 14 are each formed with openings 18 extending transversely of the outer and inner tubular members 12 and 14. The openings 18 are spaced apart longitudinally of the outer and inner tubular members 12 and 14. A retainer member in the form of a double retaining pin indicated generally by reference numeral 20 has a pair of parallel arms 22 which are spaced apart by a distance corresponding to the spacing of the openings 18 and interconnected by an intermediate portion 21 of the pin 20. By aligning the openings 18 in the outer tubular member 12 with the openings 18 in the inner tubular member 14, the arms 22 of the retaining pin 20 can be inserted through respective ones of the openings 18 in the outer tubular member 12 and respective ones of the openings 18 in the inner tubular member 14 so as to retain the outer and inner tubular members 12 against longitudinal displacement relative to one another. In this way, the length of the shore 10 can be adjusted.

The intermediate portion 21 is formed with a bend 23 extending towards the outer tubular member 12 and serving to space the intermediate portion 21 from the outer tubular member 12 on insertion of the retaining pin 20, thereby facilitating manual engagement and removal of the retaining pin 20 when required.

Figure 3:
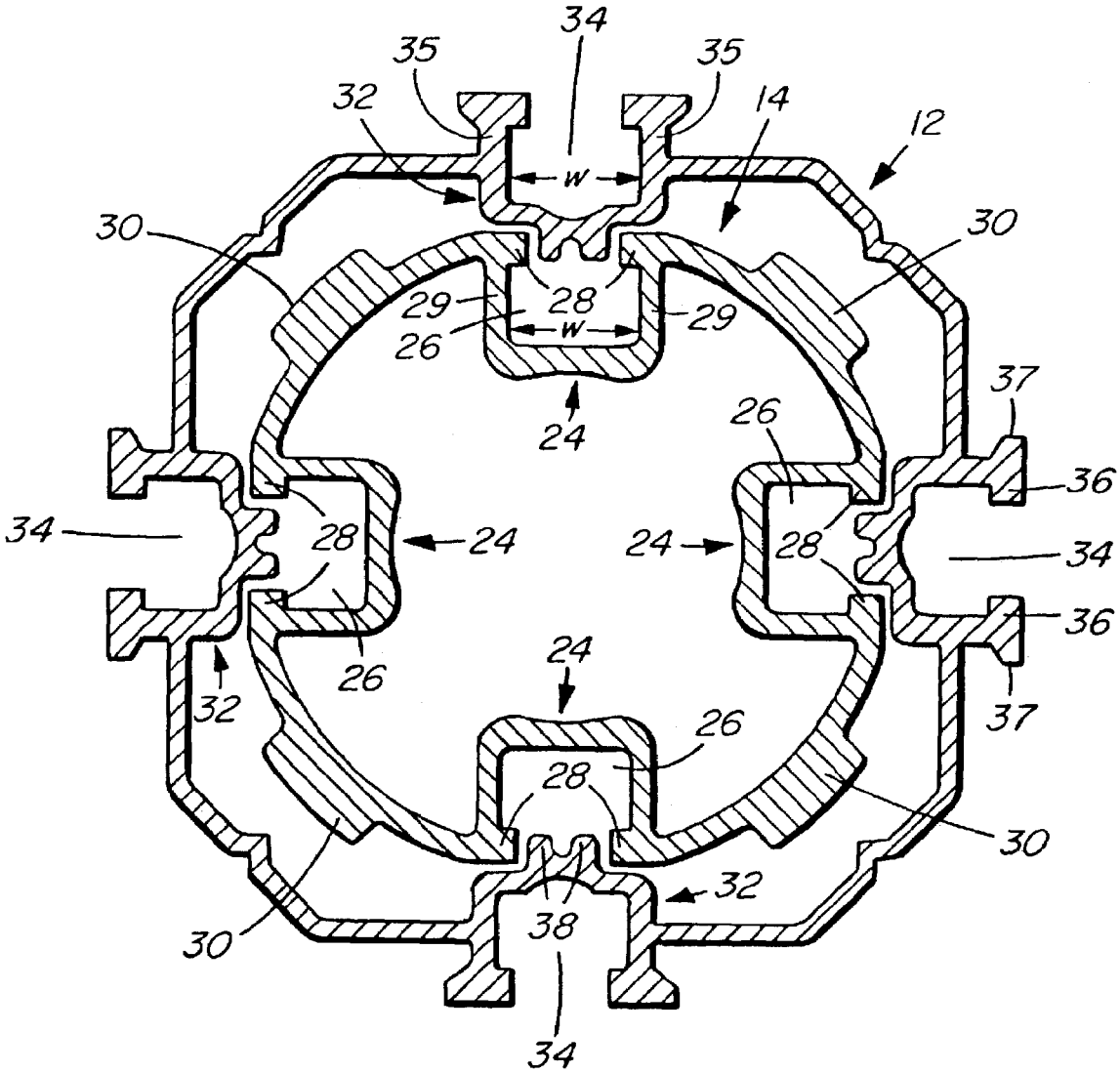
FIG. 3 shows a view taken in horizontal cross-section through inner and outer tubular members forming parts of the shore of FIGS. 1 and 2.

The cross-sectional shapes of the tubular members 12 and 14 are illustrated in FIG. 3.

As can be seen from FIG. 3, the inner tubular member 14 is formed with four inwardly projecting, recessed, longitudinal formations indicated generally by reference numerals 24 which project inwardly of the inner tubular member 14 and which form laterally outwardly open recesses 26, with spaced shoulders 28 at the outermost sides of the recesses 26. The recesses 26 have opposite side walls 29 and a width W between these side walls 29.

The inner tubular member 14 is also formed with reinforcement portions 30 which extend along the outer side of the inner tubular member and are located between the recesses 26.

The outer tubular member 12 is formed with four formations indicated generally by reference numerals 32, which extend longitudinally of the outer tubular member 12 and project inwardly and outwardly of the outer tubular member 12, the formations 32 forming recesses 34 which are open laterally outwardly of the outer tubular member 12. The recesses 34 have opposite side walls 35 which are spaced apart by a distance W, so that the recesses 34 have a width equal to that of the recesses 26.

The side walls 35 project outwardly of the outer tubular member 12 to outer ends having shoulders 36 which extend towards one another and projections 37 which extend in opposite directions from the recesses 34, the shoulders 36 and the projections 37 extending longitudinally of the outer tubular member 12.

The formations 32 also each have an innermost portion with inwardly extending projections in the form of a pair of spaced ribs 38 extending longitudinally of the outer tubular member 12. The ribs 38 project between the shoulders 28 so as to slidably engage in the recesses 26 in the inner tubular member 14 and therefore prevent relative rotation of the inner and outer tubular members 12, while allowing relative longitudinal displacement of the tubular members 12 and 14.

Figure 4:
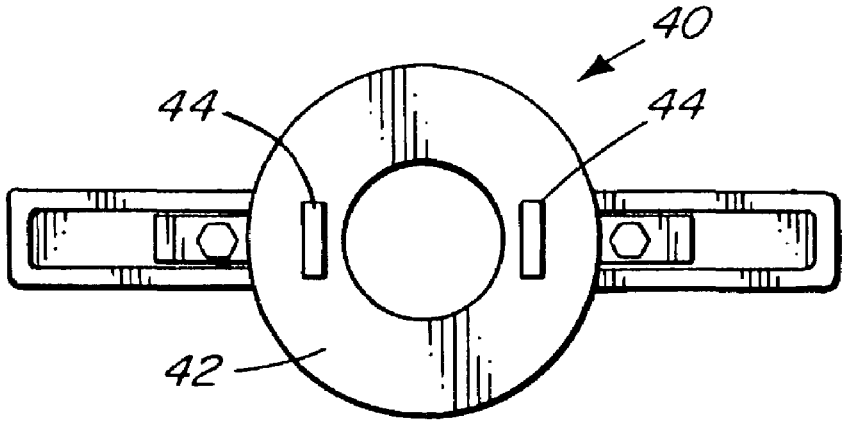
FIGS. 4 and 5 show a top plan view and a view taken in side elevation, respectively, of a retainer ring and associated components forming parts of the shore of FIGS. 1 and 2.
Figure 5:
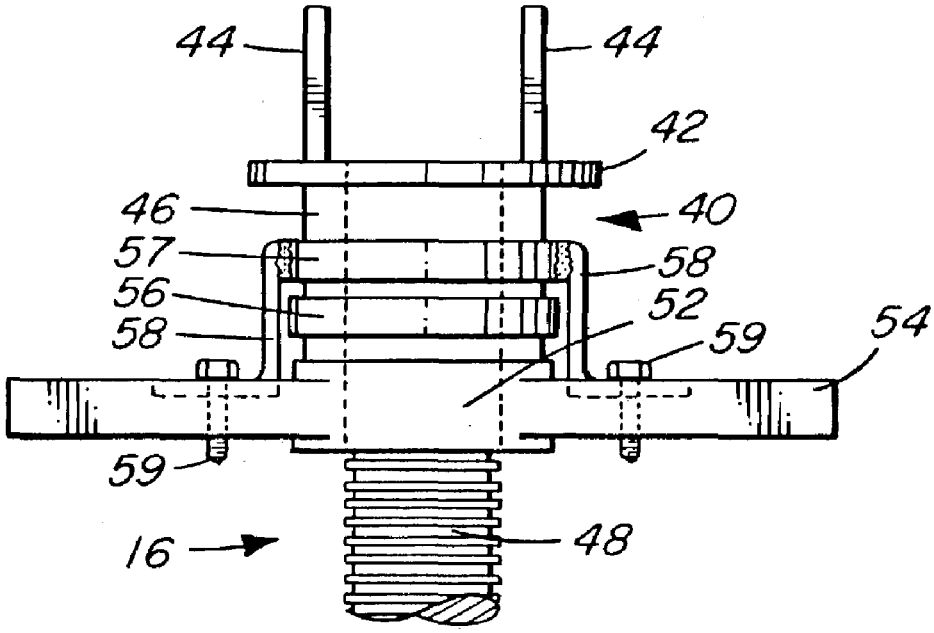

As shown in FIGS. 4 and 5, the screw jack 16 is provided with a nut and retainer assembly indicated generally by reference numeral 40, which comprises outer annular plate 42 provided with a pair of spaced, upstanding retainer projections or bars 44, which are engagable in a pair of the recesses 26 in the inner tubular member 14 at the lower end of the inner tubular member 14.

The annular plate 42 is welded onto a sleeve 46 extending around and movable freely along a screw 48 forming part of the screw jack 16. The lower end of the screw 48 is supported on a support plate 50 (FIGS. 1 and 2). The lower end of the sleeve 46 is seated on a nut 52 which is in threaded engagement with the screw 48 and which has a pair of handles or arms 54 projecting from opposite sides of the nut 52.

A first ring 56 is welded to the exterior of the sleeve 46 below a second ring 57, which is slidable along the sleeve 46. The second ring 57 is secured to the nut 52 by a pair of L-shaped retainers 58, which are welded at the upper ends to the ring 57 and secured at their lower ends to the arms 54 by bolts 59. The ring 56 is in this way retained between the nut 52 and the ring 57, so that the retainer bars 44, the annular plate 42 and the sleeve 46 are retained relative to the nut 52 and so that the nut 52 can rotate relative to the sleeve 46 and, therefore, relative to the tubular member 14 when the nut 52 is rotated about the screw 48 to adjustably raise or lower the inner tubular member 14 for fine adjustment of the length of the shore 10.

Figure 6:
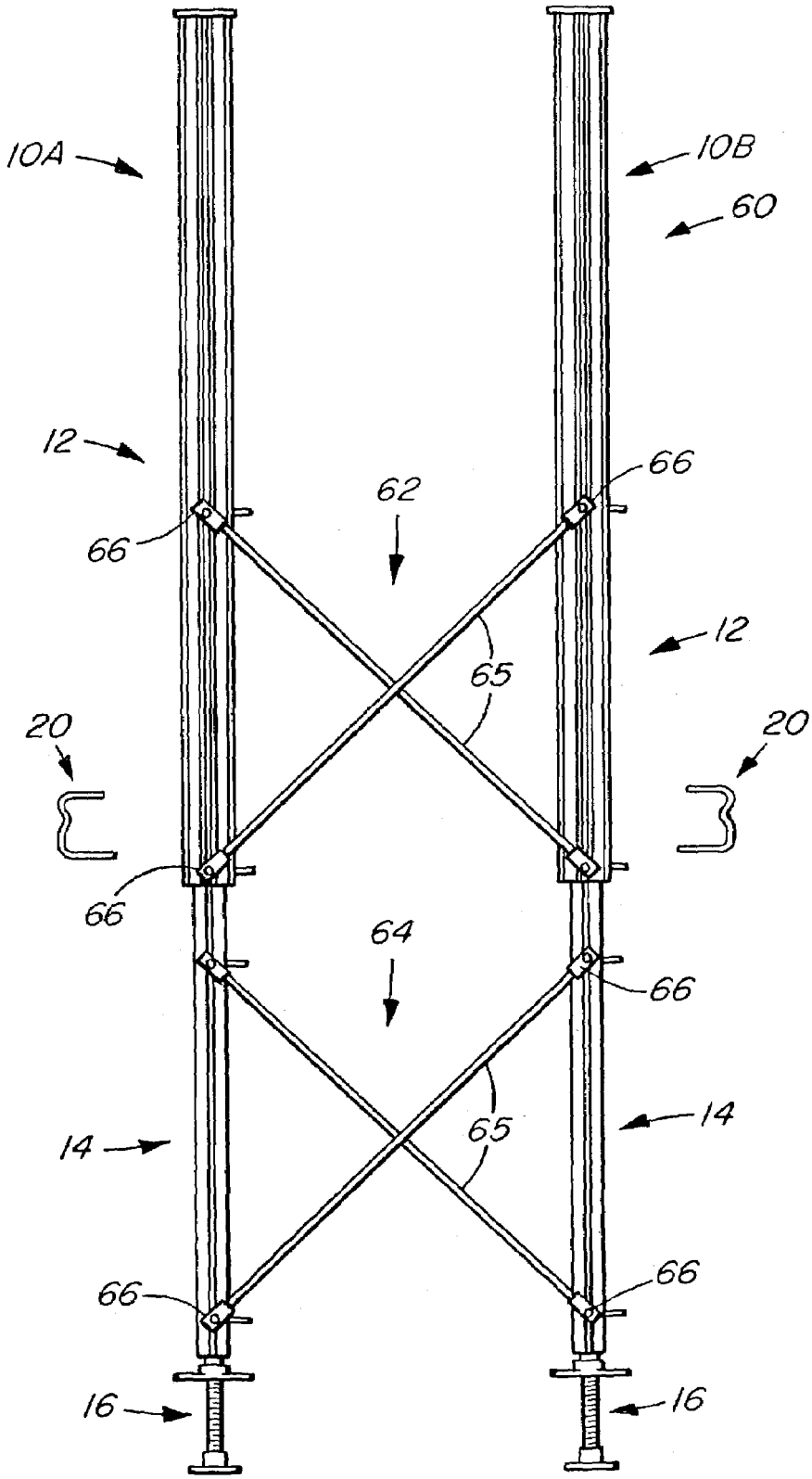
FIG. 6 shows a view in front elevation of a shore assembly comprising a pair of shores similar to the shore shown in FIGS. 1 and 2.
Figure 7:
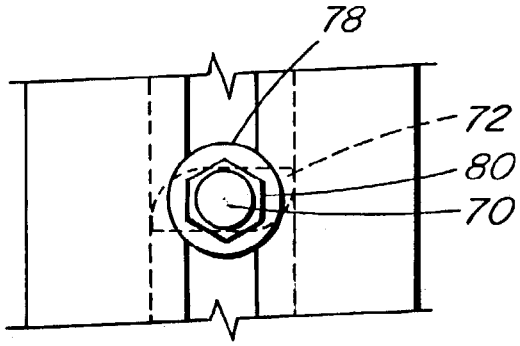
FIG. 7 shows a broken-away view, in front elevation, of parts of the shore assembly of FIG. 6.

In FIG. 6, there is shown a shore assembly indicated generally by reference numeral 60 which comprises a pair of parallel, longitudinally adjustable building construction shores, indicated generally by reference numerals 10A and 10B, each of which is similar to the shore 10 of FIGS. 1 and 2 and components of which have therefore been indicated by the same reference numerals as those used in FIGS. 1 through 5. The two shores 10A and 10B are connected together by bracing structures in the form of an upper cross-brace, indicated generally by reference numeral 62, and a lower cross-brace, indicated generally by reference numeral 64, the cross-braces 62 and 64 being formed by brace members 65.

The upper and lower cross-braces 62 and 64 are connected to outer and inner tubular members 12 and 14, respectively, of the shores 10A and 10B by connections 66, one of which is illustrated in greater detail in FIGS. 7 through 10.

Figure 10:
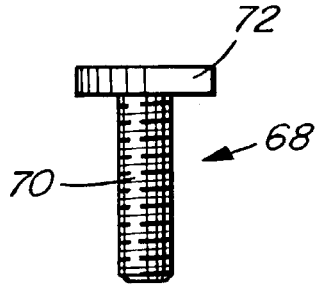
FIG. 10 shows a view taken in side elevation of the T-bolt of FIG. 9.

Referring to FIG. 10, the connection 66 comprises a T-bolt indicated generally by reference numeral 68, which has a threaded shank 70 and a head 72 welded at one end of the threaded shank 70.

Figure 9:
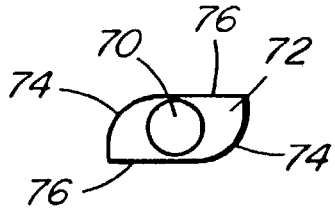
FIG. 9 shows a top plan view of a T-bolt.
Figure 8:
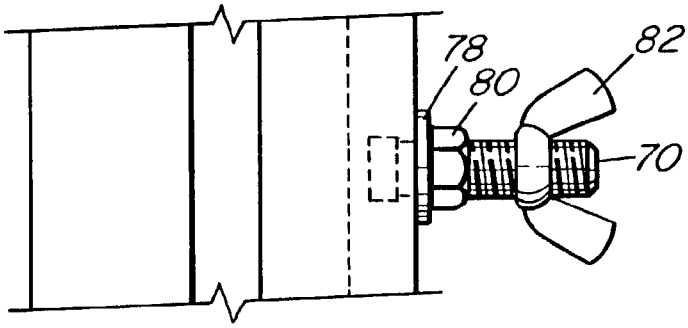
FIG. 8 shows a view in side elevation of the parts shown in FIG. 7.

As shown in FIG. 9, the head 72 has, at opposite sides of the shank 70, a curved surface 74 extending to a flat surface 76.

Figure 11:
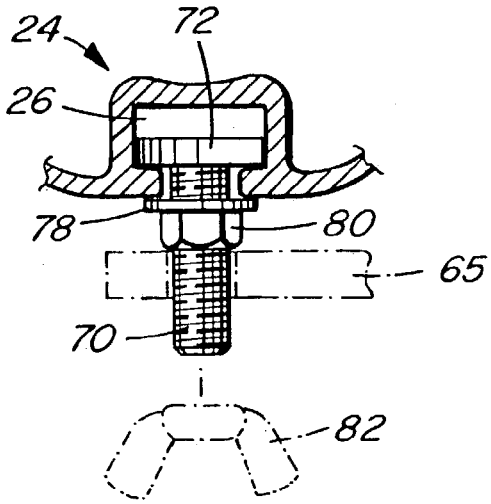
FIG. 11 shows a broken-away view, taken in horizontal cross-section along the longitudinal axis of the T-bolt of FIG. 8.

In FIG. 11, the head 72 is shown inserted into one of the recesses 26 in one of the tubular members 14 and then rotated to bring the curved surfaces 74 into jammed engagement with opposite walls of this recess 26. The head 72 is retained in this position by means of a washer 78 and a jam nut 80 in threaded engagement with the shank 70. The shank 70 extends through one end of one of the brace members 65, which is clamped against the jam nut 80 by a wing nut 82, thereby securing that brace member 65 to the inner tubular member 14.

The brace members 65 are likewise secured to the outer tubular member 12 by jammed engagement of the heads 72 of their T-bolts 68 in the recesses 34 of the two shores 10A and 10B.

The bolts 68 can be slid along the recesses 26 and 34 before being jammed into position to secure the ends of the brace members 65. The present shore assembly therefore has the important advantage that the spacing of the two shores 10A and 10B is not predetermined but is selectively variable, according to circumstances, to enable optimum load distribution on the shores to be obtained in accordance with the load capacity of the shores.

Figure 12:
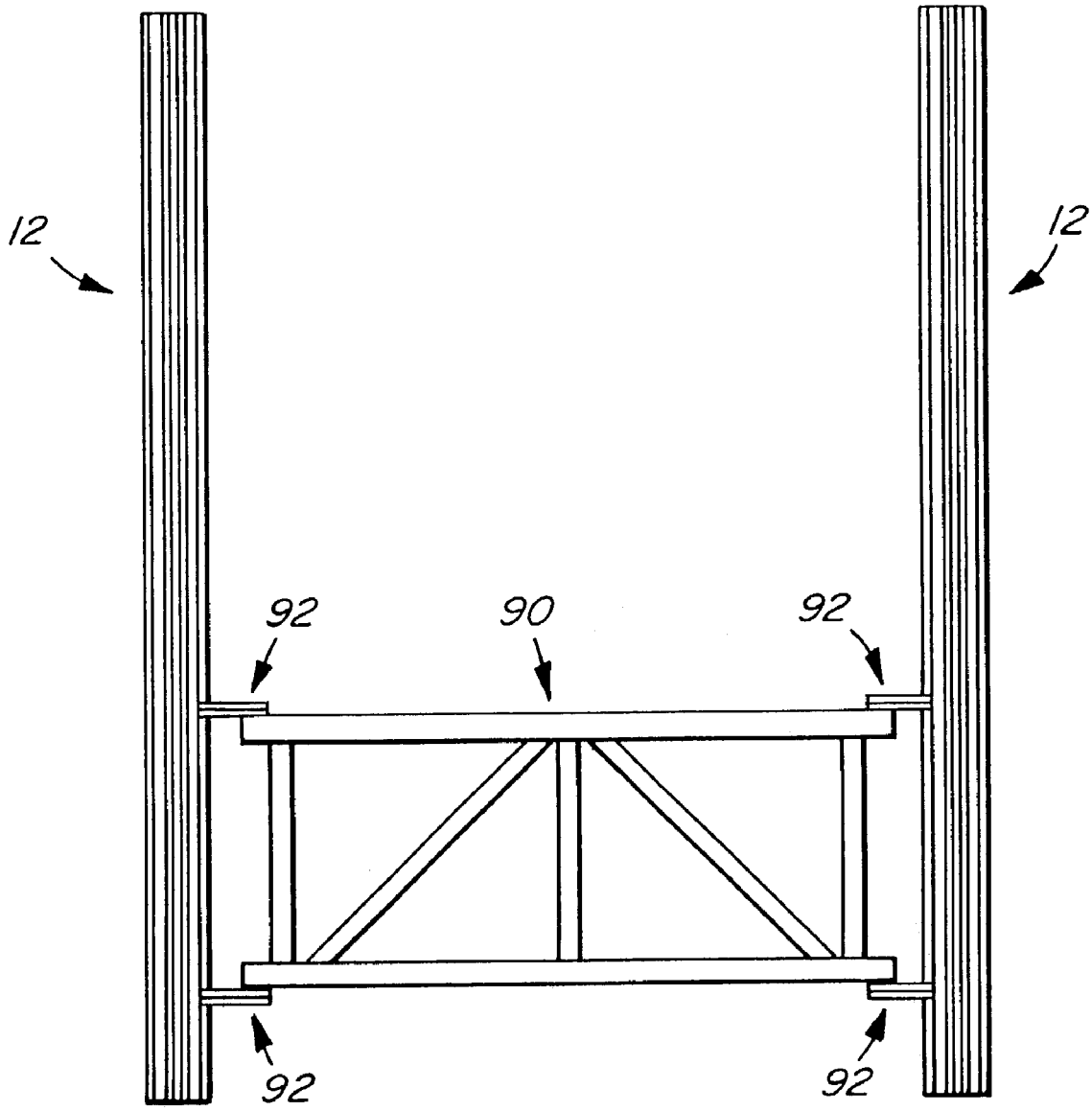
FIG. 12 shows a view in front elevation of outer tubular members such as that of FIG. 1 interconnected by a truss.
Figure 14:
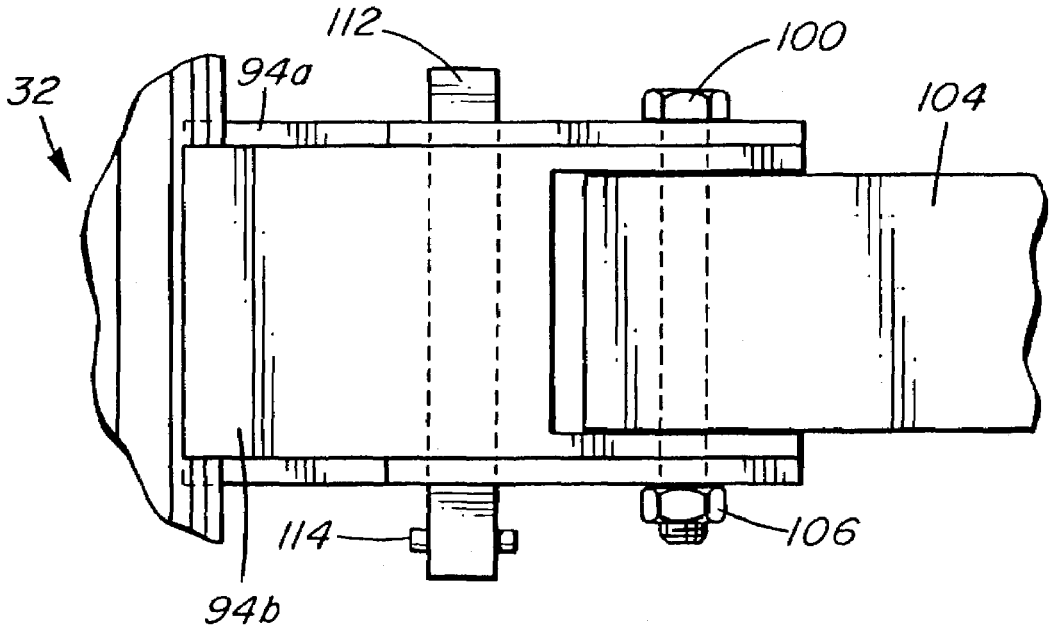
FIG. 14 shows a view in side elevation of the parts shown in FIG. 13.
Figure 15:
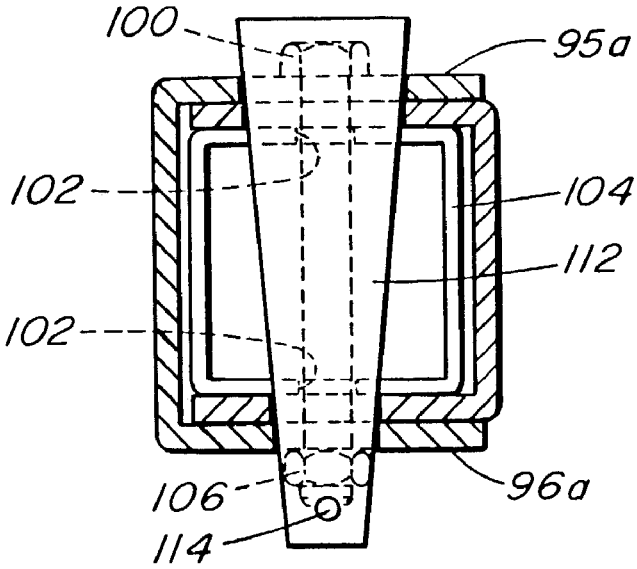
FIG. 15 shows a view taken in cross-section along the line 15—15 of FIG. 13.

FIG. 12 shows bracing structure in the form of a truss, indicated generally by reference 90, connected in place of the upper cross-brace 62 to the pair of outer tubular members 12 by four connectors, which are indicated generally by reference numerals 92. One of these connectors 92 is illustrated in greater detail in FIGS. 13 through 15.

Figure 13:
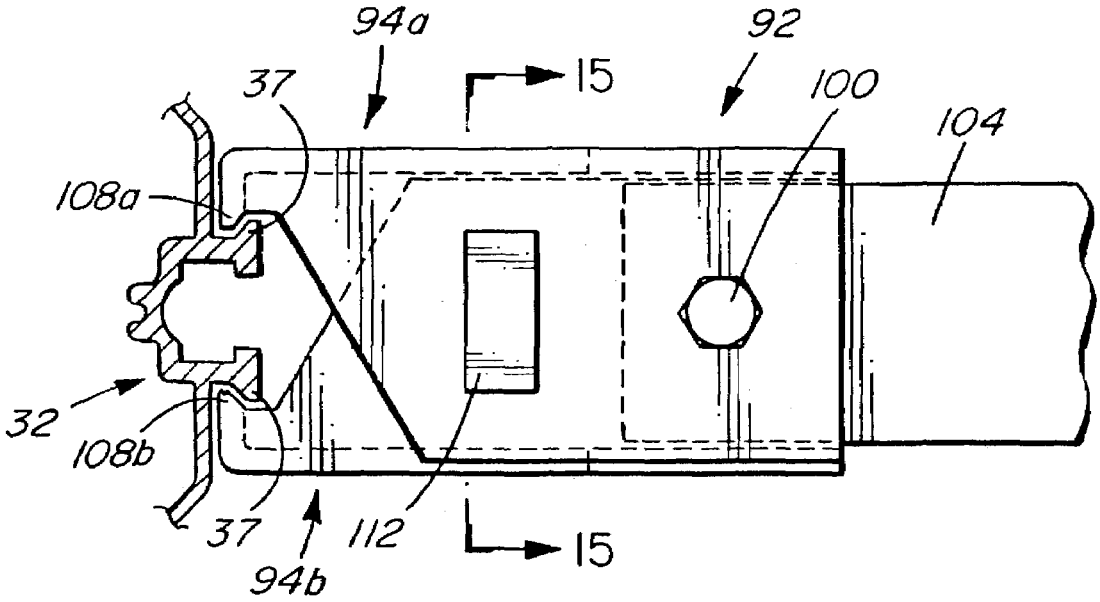
FIG. 13 shows a broken-away view, taken partly in cross-section, through one of the tubular members of FIG. 2, and showing a connection between the truss and the outer tubular member.
Figure 16:
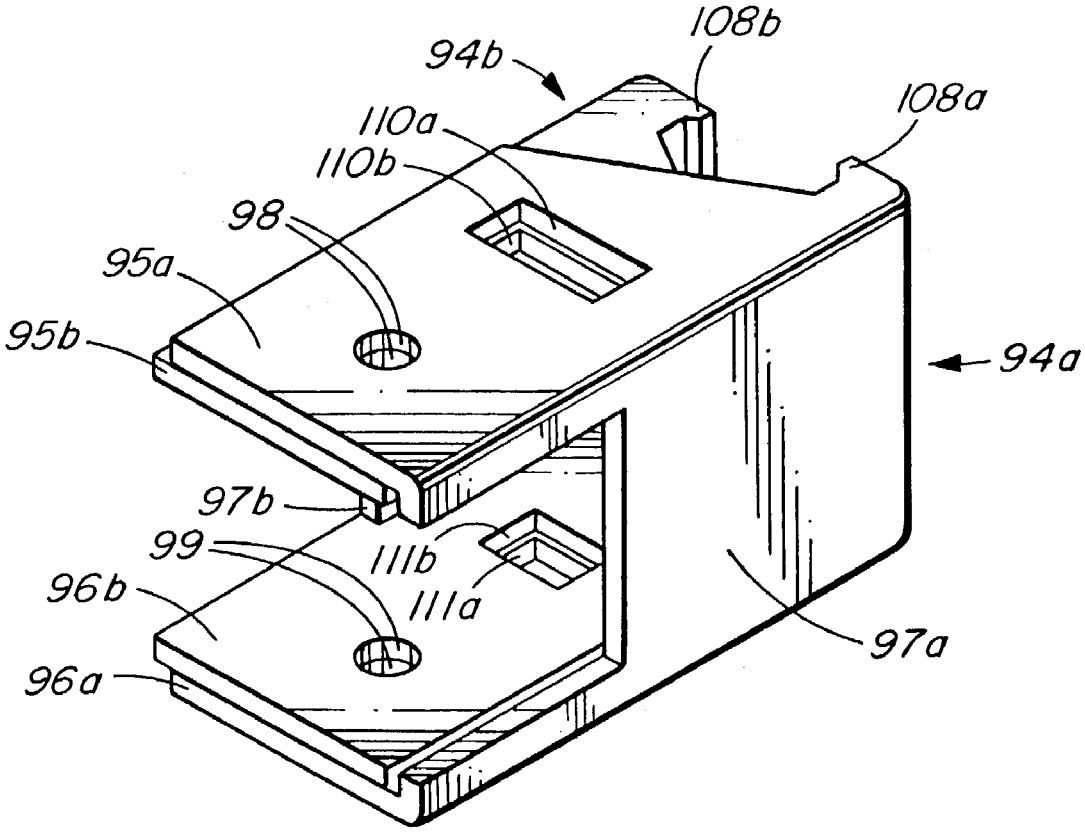
FIG. 16 shows a view in perspective of a pair of jaws forming parts of the connection of FIG. 13.

As shown in FIGS. 13 and 16, the connector 92 comprises a pair of jaws indicated generally by reference numerals 94*a*, 94*b* having flat, horizontal upper portions 95*a*, 95*b* and flat horizontal lower portions 96*a*, 96*b* connected by flat vertical intermediate portions 97*a*, 97*b*. The flat horizontal portions 95*a*, 95*b* and 96*a*, 96*b* are formed with openings 98 and 99 for receiving a bolt 100.

The bolt 100 also extends through openings 102 in a square-section end portion 104 of the truss 90 and is secured by a nut 106 beneath the underside of the horizontal lower portion 96*a* of the jaw 94*a*.

The jaws 94*a* and 94*b* are pivotable about the vertical axis of the bolt 100 between an engaged position, in which the jaws 94*a*, 94*b* are shown in FIG. 13, and in which inwardly projecting end portions 108*a*, 108*b* of the jaws 94*a* and 94*b* engage behind the oppositely laterally outwardly extending projections 37 of the formation 32 of the adjacent outer tubular member 12, and a released position, which is not shown and in which the end portions 108*a*, 108*b* are released from the projections 37.

The flat horizontal upper and lower portions 95*a*, 95*b* and 96*a*, 96*b* of the jaws 94*a*, 94*b* are also formed with rectangular openings 110*a*, 110*b* and 111*a*, 111*b*, which, in the engaged position of the jaws 94*a*, 94*b*, are vertically aligned and receive a wedge 112 having corresponding rectangular cross-sections. The wedge 112, which is retained by a wedge retainer 114 inserted through the wedge 112 beneath the jaw 94*a*, serves to releasably retain the jaws 94*a*, 94*b* in their engaged positions and, thereby, to connect the truss end portion 104 to the adjacent outer tubular member 12.

As will be apparent to those skilled in the art, various modifications and improvements may be made in the above-described embodiments of the present invention within the scope of the accompanying claims.

I claim:

1. An adjustable building construction shore comprising:

telescopically interengaged inner and outer tubular members;

said inner and outer members tubular having laterally projecting and recessed formations extending longitudinally of said inner and outer tubular members;

said projecting and recessed formations being slidably interengaged so as to allow relative longitudinal displacement of said inner and outer tubular members and to prevent relative rotation of said inner and outer tubular members;

openings extending transversely through said inner and outer tubular members and spaced apart longitudinally of said inner and outer tubular members; and a retainer member removably insertable through said openings in said inner and outer tubular members for releasably securing said inner and outer tubular members against relative longitudinal displacement; and a screw jack at a lower end of said shore;

said laterally projecting and recessed formations forming laterally outwardly open recesses in said inner and outer tubular members;

wherein said laterally projecting formations include inwardly extending projections on said outer tubular member and said inwardly extending projections slidably engage in said laterally outwardly open recesses in said inner tubular member.

2. An adjustable construction shore as claimed in claim 1, wherein said projecting formations comprise walls of said recesses in said outer tubular member, said walls having outermost ends projecting outwardly of said outer tubular member and said outermost ends having projections extending, at each of said recesses in said outer tubular member, in opposite directions from the recess and longitudinally of said outer tubular member.

3. An adjustable construction shore as claimed in claim 1, wherein said inner tubular member has a lower end supported on said screw jack and said screw jack has a pair of spaced, upstanding retainer projections engaged in said formations of said inner tubular member at said lower end of said inner tubular member.

4. An adjustable construction shore as claimed in claim 3, wherein said screwjack has a screw, a nut in threaded engagement with said screw, a sleeve extending around said screw between said nut and said retainer projections, a first ring fixed to said sleeve, a second ring extending around and slidable along said sleeve, and a connection securing said second ring to said nut, said first ring being located between said second ring and said nut so as to be retained thereby.

5. An adjustable building construction shore, comprising:

telescopically interengaged inner and outer tubular members;

said inner and outer members tubular having laterally projecting and recessed formations extending longitudinally of said inner and outer tubular members;

said projecting and recessed formations being slidably interengaged so as to allow relative longitudinal displacement of said inner and outer tubular members and to prevent relative rotation of said inner and outer tubular members;

openings extending transversely through said inner and outer tubular members and spaced apart longitudinally of said inner and outer tubular members; and a retainer member removably insertable through said openings in said inner and outer tubular members for releasably securing said inner and outer tubular members against relative longitudinal displacement; and a screw jack at a lower end of said shore;

said retainer member comprising a double pin having a pair of parallel spaced arms and an intermediate portion between said arms, said intermediate portion being formed with a bend to facilitate manual engagement of said intermediate portion.

6. A shore assembly, comprising a pair of parallel, longitudinally adjustable building construction shores, a bracing structure between said building construction shores and connections between said bracing structure and said building construction shores, wherein said building construction shores each comprise telescopically interengaged inner and outer tubular members; said outer tubular members have formations; said formations each include oppositely laterally outwardly extending projections extending longitudinally of said outer tubular members; and said connections include jaws pivotable into an engaged position, in which said jaws engage said laterally outwardly extending projections.

7. A shore assembly as claimed in claim 6, wherein said connections include openings in said the jaws and wedges in said openings for retaining said jaws in said engaged position.

8. A shore assembly as claimed in claim 7, wherein said formations are laterally projecting and recessed formations extending longitudinally of said inner and outer tubular members; said projecting and recessed formations being slidably interengaged so as to allow all relative longitudinally displacement of said inner and outer tubular members and to prevent relative rotation of said inner and outer tubular members; said shores each including openings extending transversely through said inner and outer tubular members and spaced apart longitudinally of said inner and outer tubular members; a retainer member removably insertable through said openings for releasing the securing said inner and outer tubular members against relative longitudinal displacement; and a screwjack provided at a lower end of said shore.

9. A shore assembly, comprising a pair of parallel, longitudinally adjustable building construction shores, a bracing structure between said building construction shores and connections between said bracing structure and said building construction shores, wherein said building construction shores each comprise telescopically interengaged inner and outer tubular members; said outer tubular members have formations; said formations each include oppositely laterally outwardly extending projecting and recessed formations extending longitudinally of said inner and outer tubular members; and said connections include jaws pivotable into an engaged position, in which said jaws engage said laterally outwardly extending projections; said projecting and recessed formations being slidably interengaged so as to allow relative longitudinal displacement of said inner and outer tubular members and to prevent relative rotation of said inner and outer tubular members; openings extending transversely through said inner and outer tubular members and spaced apart longitudinally of said inner and outer tubular members; a retainer member removably insertable through said openings in said inner and outer tubular members for releasably securing said inner and outer tubular members against relative longitudinal displacement; and a screwjack at a lower end of said shore; said laterally projecting and recessed formations forming laterally outwardly open recesses in said inner and outer tubular members; and said retainer member comprising a double pin having a pair of parallel spaced arms and an intermediate portion between said arms, said intermediate portion being formed with a bend to facilitate manual engagement of said intermediate portion.

10. A shore assembly, comprising a pair of parallel, longitudinally adjustable building construction shores, a bracing structure between said building construction shores and connections between said bracing structure and said building construction shores, wherein said building construction shores each comprise telescopically interengaged inner and outer tubular members; said inner and outer tubular members each have laterally outwardly open recesses extending longitudinally of said inner and outer tubular members; and said connections are each engageable in said laterally outwardly open recesses of said inner and outer tubular members for connecting said bracing structure to said inner and outer tubular members, said laterally outwardly open recesses having opposite walls and said connections comprising heads rotatable in any one of said laterally outwardly open recesses into jammed engagement with said opposite walls.

11. A shore assembly as claimed in claim 10, including a screw jack, wherein said inner tubular member has a lower end supported on said screw jack and said screw jack has a pair of spaced, upstanding retainer projections engaged in said inner tubular member at said lower end of said inner tubular member.

12. An adjustable construction shore as claimed in claim 11, wherein said screw jack has a screw, a nut in threaded engagement with said screw, a sleeve extending around said screw between said nut and said retainer projections, a first ring fixed to said sleeve, a second ring extending around and slidable along said sleeve, and means for securing said second ring to said nut, said first ring being located between said second ring and said nut so as to be retained thereby.

13. A shore assembly as claimed in claim 10, wherein said inner and outer members tubular have laterally projecting and recessed formations extending longitudinally of said inner and outer tubular members, said projecting and recessed formations being slidably interengaged so as to allow relative longitudinal displacement of said inner and outer tubular members and to prevent relative rotation of said inner and outer tubular members, said inner and outer tubular members having openings extending transversely through said inner and outer tubular members and are spaced apart longitudinally of said inner and outer tubular members, said shore assembly including a retainer member removably insertable through said openings in said inner and outer tabular members for releasably securing said inner and outer tubular members against relative longitudinal displacement.

14. A shore assembly as claimed in claim 13, wherein said projecting formations comprise walls of said recesses in said outer tubular member, said walls having outermost ends projecting outwardly of said outer tubular member and said outermost ends having projections extending, at each of said recesses in said outer tabular member, in opposite directions from the recess and longitudinally of said outer tubular member.

* * * * *